United States Patent [19]

Bengel et al.

[11] Patent Number: 5,046,289

[45] Date of Patent: Sep. 10, 1991

[54] SYSTEM AND METHOD FOR CLEANING THE INNER SURFACE OF TUBULAR MEMBERS

[75] Inventors: Thomas G. Bengel; Edward A. Ray, both of Plum Boro; Phillip E. Miller, Greensburg; Frank I. Bauer, Perry; James Sejvar, Murrysville, all of Pa.

[73] Assignee: Westinghouse Electric Corp., Pittsburgh, Pa.

[21] Appl. No.: 307,103

[22] Filed: Feb. 6, 1989

[51] Int. Cl.[5] ..... B24C 3/16; B24C 9/00

[52] U.S. Cl. ..... 51/411; 51/410; 15/104.05; 15/104.1 R; 15/104.09

[58] Field of Search ..... 51/411, 424, 429, 410; 118/DIG. 10, 317; 15/3.5, 104.09, 104.05, 104.03, 104.1 R

[56] References Cited

U.S. PATENT DOCUMENTS

| | | | |
|---|---|---|---|
| 1,045,742 | 11/1912 | Pontani | 51/411 |
| 1,952,848 | 3/1934 | Eckler | 51/411 |
| 2,089,597 | 8/1937 | Carter | 51/411 |
| 2,117,648 | 5/1938 | Bottorf | 51/411 |
| 2,399,544 | 4/1946 | Danner | 118/DIG. 10 |
| 3,058,137 | 10/1962 | Doyle | 51/411 |
| 3,106,491 | 10/1963 | Leibner | 118/DIG. 10 |
| 3,319,710 | 5/1967 | Heeren et al. | 165/95 |
| 3,446,666 | 5/1969 | Bodine | 134/1 |
| 3,451,091 | 6/1969 | Wallace | 15/104.6 |
| 3,615,817 | 10/1971 | Jordan et al. | 134/3 |
| 3,778,938 | 12/1973 | Korn et al. | 51/320 |
| 3,825,443 | 7/1974 | Reilly | 134/24 |
| 3,894,364 | 7/1975 | Korn et al. | 51/320 |
| 3,895,465 | 7/1975 | Korn et al. | 51/320 |
| 3,902,276 | 9/1975 | Jarvis | 51/411 |
| 4,219,976 | 9/1980 | Burack et al. | 51/411 |
| 4,314,427 | 2/1982 | Stoltz | 51/411 |
| 4,326,317 | 4/1982 | Smith et al. | 15/302 |
| 4,333,277 | 6/1982 | Tasedan | 51/425 |
| 4,374,462 | 2/1983 | Wojcik et al. | 51/411 |
| 4,483,205 | 11/1984 | Bellaiche et al. | 73/864.23 |
| 4,521,844 | 6/1985 | Sturges, Jr. et al. | 364/167 |
| 4,563,841 | 1/1986 | Hart et al. | 51/411 |
| 4,622,709 | 11/1986 | Matsuda | 15/4 |
| 4,715,324 | 12/1987 | Muller et al. | 122/381 |
| 4,720,369 | 1/1988 | Cadaureille et al. | 376/248 |
| 4,763,376 | 8/1988 | Spurlock, Jr. et al. | 15/104.09 |

FOREIGN PATENT DOCUMENTS

| | | | |
|---|---|---|---|
| 0221962 | 9/1988 | Japan | 51/290 |
| 0656330 | 6/1986 | Switzerland | 15/104.05 |
| 2200970 | 8/1988 | United Kingdom | 15/104.05 |

*Primary Examiner*—Robert A. Rose

*Attorney, Agent, or Firm*—Walter S. Stevens

[57] ABSTRACT

System and method for abrading radioactive contaminants from the inside surface of a pipe. The system includes a nozzle block capable of mixing a liquid and an abrasive grit into a suitable liquid-abrasive grit cleaning composition and impinging the cleaning composition against the inside surface of the pipe. The system further includes an inflatable torus-shaped seal for confining the liquid-abrasive grit cleaning composition to a predetermined portion of the inside surface of the pipe so that substantially all of the contaminants and cleaning composition can be suitably vacuumed from the surface.

15 Claims, 10 Drawing Sheets

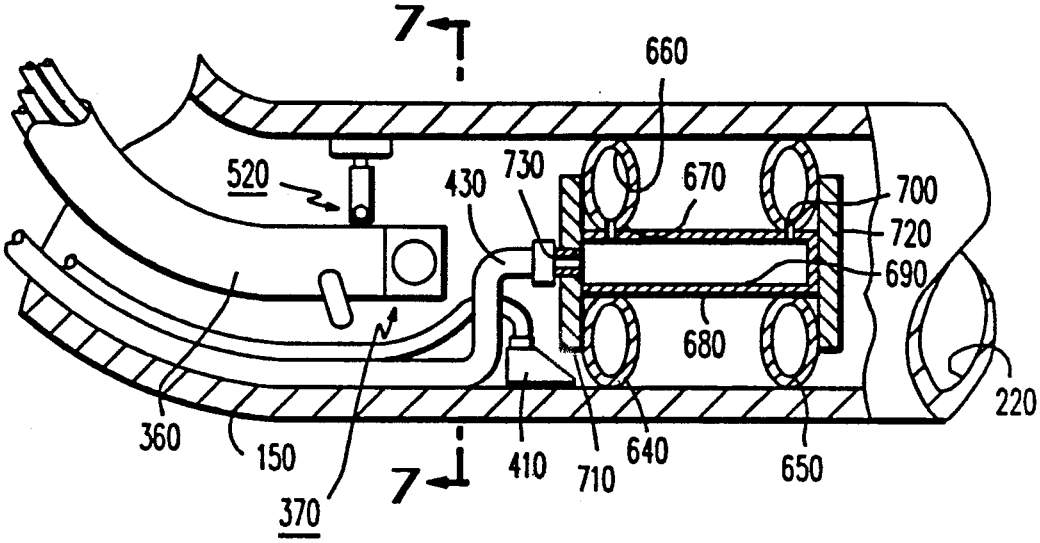
FIG. 6
FIG. 7
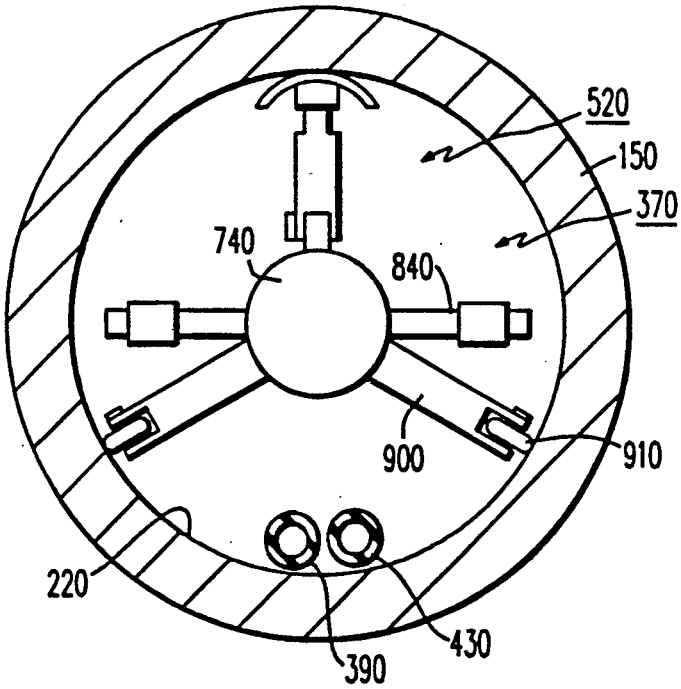

SYSTEM AND METHOD FOR CLEANING THE INNER SURFACE OF TUBULAR MEMBERS

BACKGROUND OF THE INVENTION

This invention generally relates to systems and methods for cleaning the inner surface of tubular members and more particularly relates to a system and a method for abrading radioactive contaminants from the inside surface of a pipe.

A nuclear reactor power plant produces heat which is transferred to a liquid moderator that in turn circulates through at least one heat exchanger or steam generator for producing steam. The steam produced in the steam generator is then transferred to a turbine-generator for generating electricity in a manner well known in the art of nuclear power production. However, the circulating liquid moderator typically has dissolved and suspended radioactive solids therein. These highly radioactive solids usually are radioactive corrosion products formed from within the reactor, the plant piping system and the plant equipment through which the moderator circulates. During operation of the nuclear reactor, these radioactive corrosion products may form a sediment which will deposit on the inside surfaces of the plant piping system and plant equipment. In order to safely perform some types of maintenance (e.g., steam generator replacement) on the nuclear reactor power plant these highly radioactive deposits should be removed.

Of course, replacing a steam generator requires severing the end of the piping connected thereto and removing the steam generator. Thus, one end of the piping is exposed because it has been severed, and the other end of the piping is inaccessible because the other end of the piping remains connected to plant equipment. In any case, after the steam generator is removed, the radiation field emitting through the exposed pipe stubs, due to the radioactive sediments on the inside surface of the piping, may expose maintenance workers to an undesirable level of radiation. For example, the radiation field emitting through the pipe stubs may expose maintenance workers to the maximum allowable radiation dosage in only a few minutes of working time. Using many maintenance workers, wherein the radiation dose to any one worker is relatively low, is prohibitively expensive. Therefore, it is desirable to reduce the radiation dosage rate to a value that is as low as reasonably achievable in order to reduce the radiation exposure to maintenance workers who are performing the steam generator replacement. Cleaning of highly radioactive sediments from the inside surfaces of the piping, particularly sediments on the inside surface of the piping near the pipe stubs, will reduce the radiation exposure to maintenance workers performing the steam generator replacement. Moreover, it is important to suitably confine and remove the deposits cleaned from the inside surface so that the deposits are not transported through the piping to other reactor components where such deposits may contaminate and damage these other components. Therefore, one problem in the art has been to suitably remove the radioactive sediments from the inside surfaces of the piping so that the radiation fields emitting through the pipe stubs are reduced to a value that is as low as reasonably achievable. Another problem in the art has been to suitably confine and then suction the removed deposits and cleaning composition so that the removed deposits and cleaning composition are not transported through the piping to other reactor components.

A method of chemically decontaminating radioactive surfaces is disclosed by U.S. Pat. No. 3,615,817 issued Oct. 26, 1971, in the name of William T. Jordan, et al. entitled "Method of Decontaminating Radioactive Metal Surfaces". The Jordan, et al. patent discloses a method wherein decontamination is attained by employing a foam containing a chemical reagent which will chemically attack the radioactive contamination on the surface. Although the Jordan, et al. patent discloses a method of chemically decontaminating radioactive surfaces, this patent does not appear to disclose an apparatus for chemically decontaminating radioactive surfaces. Moreover, the Jordan, et al. patent does not appear to disclose either an apparatus or a method for mechanically decontaminating radioactive surfaces.

In general, chemical decontamination of nuclear power plant components, such as piping, is unacceptable for various reasons. For example, radioactive contamination is usually strongly bonded to the inner surface of the component; therefore, chemical decontamination may not adequately remove the contamination. In addition, transport of such chemicals to components other than the component being cleaned may lead to undesirable chemical attack and damage to other portions of the power plant. Therefore, another problem in the art has been to positively clean the inner surface of power plant components without the use of chemicals.

An apparatus for mechanically, rather than chemically, decontaminating a heat exchange tube is disclosed by U.S. Pat. No. 4,326,317 issued Apr. 27, 1982, in the name of Edward H. Smith, et al. entitled "Decontamination Apparatus" and assigned to the Westinghouse Electric Corporation. The Smith, et al. patent discloses a decontamination apparatus comprising a rotatable hone and brush capable of being inserted into a heat exchange tube of a nuclear steam generator for mechanically removing contamination from the inside of the heat exchange tube by contacting the inside of the tube. However, the Smith, et al. patent does not appear to disclose a system and method for decontaminating the inside surface of a tube using a dry abrasive grit and/or a liquid under pressure.

A device for mechanically cleaning instrumentation guide tubes using water under pressure is disclosed by U.S. Pat. No. 4,720,369 issued Jan. 19,1988, in the name of Gerard Cadaureille, et al. entitled "Device For Cleaning The Guide Tubes Of The Means of Measuring Neutron Fluxes in a Pressurized-Water Nuclear Reactor". The Cadaureille, et al. patent discloses a device for cleaning the instrumentation guide tubes of a pressurized-water nuclear reactor, comprising a pump for injecting demineralized water under pressure in the tubes to remove solid particles and an assembly for recovering the radioactive waste. Although the Cadaureille, et al. patent discloses a device for cleaning instrumentation guide tubes, the Cadaureille, et al. patent does not appear to disclose a system and method using a liquid-abrasive grit cleaning composition under pressure to clean the inside surface of the tube. Moreover, the Cadaureille, et al. patent does not appear to contemplate a system and method including seal means for confining the liquid-abrasive grit composition to a predetermined portion of the inside surface of the tube so that substantially all of the solid particles can be removed from the tube.

An apparatus for mechanically cleaning a pipe using a scraping device and a mixed flow of compressed air and abrasive material is disclosed by U.S. Pat. No. 4,622,709 issued Nov. 18, 1986, in the name of Shinichi Matsuda entitled "Cleaning Apparatus For Pipes". The Matsuda patent discloses a cleaning apparatus for a pipe which comprises at least one scraping device and a grinding device which is connected behind the scraping device. The scraping device has scraping segments which have scraping portions able to contact the inner surface of the pipe for removing deposits. The grinding device is provided for removing deposits which have not been removed by the scraping portions. The grinding device includes a rotatable ejection pipe terminating in a nozzle which ejects a mixed flow of compressed air and abrasive material such as sand, etc. for removing deposits; thus, the Matsuda patent does not appear to contemplate use of a liquid-abrasive grit composition to decontaminate the inner surface of the pipe. Further, although the Matsuda patent discloses a cleaning apparatus for pipes, the Matsuda patent appears to require both ends of the pipe to be accessible; thus, the Matsuda apparatus appears incapable of being used as intended when only one end of the pipe is accessible, such as is the case during the typical nuclear steam generator replacement. Moreover, although the Matsuda patent may disclose a scraping device and a grinding device for removing deposits from the inside surface of a pipe, the Matsuda patent does not appear to disclose seal means disposed near the scraping device and grinding device for suitably confining the removed deposits and abrasive grit material to a predetermined portion of the inside surface of the pipe so that substantially all of the deposits and abrasive grit material can be removed from the surface after the cleaning operation.

A sand-blasting and vacuum apparatus is disclosed by U.S. Pat. No. 4,333,277 issued June 8, 1982, in the name of Robert T. Tasedan entitled "Combination Sand-blasting and Vacuum Apparatus". The Tasedan patent discloses a sand-blasting apparatus which is operated by a vacuum system, wherein there is provided a sand-blasting gun having an air-inlet passage and a sand-inlet passage. Air is discharged into a mixing chamber, creating a vacuum therein to suck sand through the sand-inlet passage, and to discharge the sand through a nozzle under high-velocity so as to impinge against the work surface to be sanded. The sand is captured within the enclosed discharge end of the gun and then returned to the sand-storage tank. According to this patent, the sand is captured by a cup-like housing formed from resilient material provided with a resilient annular-seal member to be pressed against the work surface for capturing used sand and for allowing the used sand to be sucked back to the sand-storage tank. Although the Tasedan patent discloses a sand-blasting apparatus, the Tasedan patent does not appear to contemplate use of a liquid-abrasive grit composition for cleaning the work surface. Moreover, although the Tasedan patent discloses a cup-like housing provided with a resilient annular-seal member to be pressed against the work surface, the Tasedan patent does not appear to disclose seal means engaging the entire periphery of the inside surface of a pipe for confining a liquid-abrasive grit composition to a predetermined portion of the inside surface of the pipe.

Consequently, although the patents recited hereinabove disclose various apparatus and a method for cleaning the inner surface of tubular members, these patents do not appear to disclose a system and method for abrading radioactive contaminates from the inside surface of a tubular member, wherein the system includes suitable seal means for confining the abrasive cleaning composition and removed deposits to a predetermined portion of the inside surface of the tubular member so that substantially all of the contaminants and cleaning composition can be removed from the surface after the cleaning operation.

Therefore, what is needed is a system and a method for abrading radioactive contaminants from the inside surface of a tubular member, wherein the system includes suitable seal means for confining a liquid-abrasive grit cleaning composition and contaminants to a predetermined portion of the inside surface of the tubular member so that substantially all of the contaminants and cleaning composition can be removed from the surface after the cleaning operation.

SUMMARY OF THE INVENTION

Disclosed herein are a system and a method for abrading radioactive contaminants from the inside surface of a pipe. The system includes a nozzle block capable of mixing a liquid and an abrasive grit into a suitable liquid-abrasive grit cleaning composition and impinging the cleaning composition against the inside surface of the pipe to clean the pipe. The system further includes an inflatable torus-shaped seal for confining the liquid-abrasive grit cleaning composition and abraded contaminants to a predetermined portion of the inside surface of the pipe so that substantially all of the contaminants and cleaning composition can be vacuumed from the surface.

An object of the invention is to provide a system for cleaning the inside surface of a tubular member, comprising cleaning means capable of being positioned in the tubular member for dispensing a cleaning composition onto the inside surface of the tubular member to clean the inside surface of the tubular member.

Another object of the invention is to provide-a system for cleaning the inside surface of a tubular member, comprising seal means capable of being disposed near the cleaning means and capable of contacting the inside surface of the tubular member for confining the cleaning composition to a predetermined portion of the inside surface of the tubular member.

Yet another object of the invention is to provide a system for cleaning the inside surface of a tubular member, further comprising alignment means connected to the cleaning means for aligning the cleaning means along the longitudinal axis of the tubular member.

A further object of the invention is to provide a method for abrading contaminants from the inside surface of a pipe having an open end, the method comprising the steps of positioning cleaning means in the pipe for spraying a cleaning composition under pressure against the inside surface of the pipe to abrade the contaminants from the inside surface of the pipe, positioning inflatable seal means in the pipe for sealably engaging the inside surface of the pipe to confine the cleaning composition and abraded contaminants to a predetermined portion of the inside surface of the pipe, inflating the seal means into intimate sealing engagement with the periphery of the inside surface of the pipe, and engaging alignment means with the inside surface of the pipe for stabilizing the cleaning means in the pipe and for aligning the cleaning means parallel to the longitudinal axis of the pipe.

Another object of the invention is to provide a method for abrading contaminants from the inside surface of a pipe having an open end, the method comprising rinsing the inside surface of the pipe to wash residual cleaning composition and abraded contaminants from the inside surface of the pipe.

These and other objects of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

While the specification concludes with claims particularly pointing out and distinctly claiming the subject matter of the invention, it is believed the invention will be better understood from the following description, taken in conjunction with the accompanying drawings wherein:

FIG. 6 is a view in partial vertical section of the inflatable seal disposed in the pipe and of a fixture disposed in the pipe for abrading the inside surface of the pipe;

FIG. 7 is a view of the fixture disposed in the pipe taken along section VII—VII of FIG. 6;

DESCRIPTION OF THE PREFERRED EMBODIMENTS

Replacing a nuclear steam generator requires severing the end of the piping connected thereto and removing the steam generator. After the steam generator is removed, the radiation field emitted through the exposed pipe stubs due to radioactive sediments on the inside surface of the piping may expose maintenance workers to an undesirable level of radiation. Cleaning of the highly radioactive sediments from the inside surfaces of the piping, particularly from the inside surface of the piping near the pipe stubs, will reduce the radiation exposure to maintenance workers performing the steam generator replacement. Disclosed herein is a system and a method for abrading radioactive contaminants from the inside surface of pipes.

Figure 1:
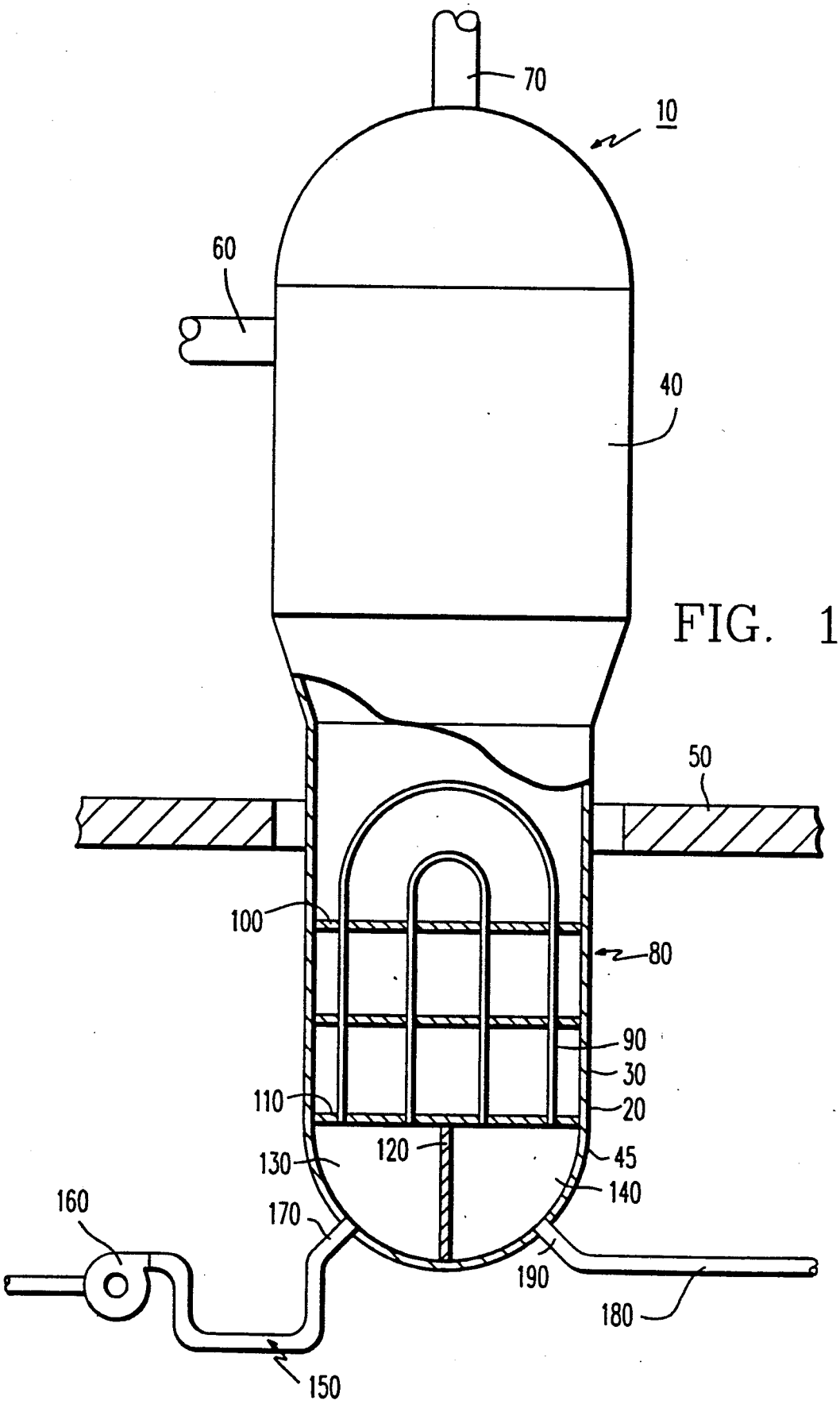
FIG. 1 is a view in partial vertical section of a nuclear steam generator with parts removed for clarity.

Referring to FIG. 1, there is illustrated a vertical nuclear heat exchanger or steam generator, generally referred to as 10, for producing steam (not shown). The steam generator includes a generally cylindrical shell 20 having a lower portion 30 and an upper portion 40. The lower portion 30 includes a hemispherical channel head 45. Surrounding shell 20 is a horizontal operating floor 50 providing means for routine access to steam generator 10. Steam generator 10 further includes a feedwater line 60 connected to upper portion 40 for supplying feedwater (not shown) to the interior of shell 20, which feedwater is ultimately converted to steam in the manner described hereinbelow. Also connected to upper portion 40 is a main steam line 70 for conducting the steam out of steam generator 10. Moreover, disposed in shell 20 is a vertical tube bundle, generally referred to as 80, comprising a plurality of vertical, inverted U-shaped steam generator tubes 90. Disposed at various locations along the length of bundle 80 are a plurality of horizontal tube support plates 100 having holes therein for receiving each tube 90. Disposed in lower portion 30 and below the bottom-most support plate is a horizontal tube sheet 110 having a plurality of vertical apertures therethrough for receiving the ends of tubes 90. Disposed in channel head 45 is a vertical, semi-circular divider plate 120 for dividing channel head 45 into an inlet plenum chamber 130 and an outlet plenum chamber 140. Connected to channel head 45 is an inlet pipe 150 containing radioactive reactor coolant or liquid moderator (not shown) heated by a nuclear reactor (not shown). As illustrated in FIG. 1, the inlet pipe 150 has a reactor coolant pump 160 associated therewith for pumping the liquid moderator through steam generator 10. Inlet pipe 150 has a first end 170 in fluid communication with inlet plenum chamber 130 for conducting the radioactive moderator into inlet plenum chamber 130. Inlet pipe 150 also has a second end (not shown) connected to other equipment in the power plant. Moreover, connected to channel head 45 is an outlet pipe 180. Outlet pipe 180 has a first end 190 in fluid communication with outlet plenum chamber 140 for conducting the radioactive moderator out of outlet plenum chamber 140. Outlet pipe 180 also has a second end (not shown) connected to other equipment in the power plant. During operation of steam generator 10, the liquid moderator enters inlet plenum chamber 130 through inlet pipe 150 and flows through tubes 90 to outlet plenum chamber 140 where the moderator exits steam generator 10 through outlet pipe 180. As the moderator travels through tubes 90, it releases its heat to the feedwater which enters upper portion 40 through feedwater line 60 and which flows downwardly until it is in fluid communication with tube bundle 80 and tube sheet 110. As the feedwater receives the heat through tubes 90 from the moderator, the feedwater boils and vaporizes into steam which exits steam generator 10 through main steam line 70. The steam is ultimately transported to a turbine-generator for generating electricity in a manner well known in the art. However, it may be necessary to plug some tubes 90 that may have developed leaks during operation of steam generator 10. If it becomes necessary to plug more than a reasonable number of such tubes, it may be necessary to replace steam generator 10.

Figure 2:
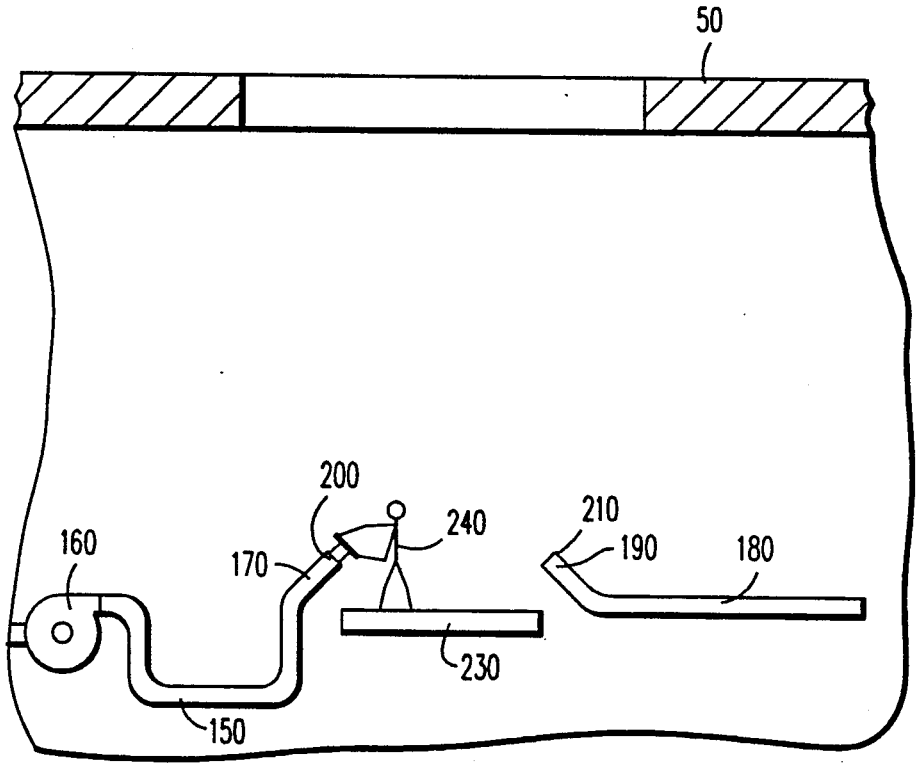
FIG. 2 illustrates an operator standing on a workman's platform in position to clean a steam generator inlet pipe after the steam generator has been removed.
Figure 3:
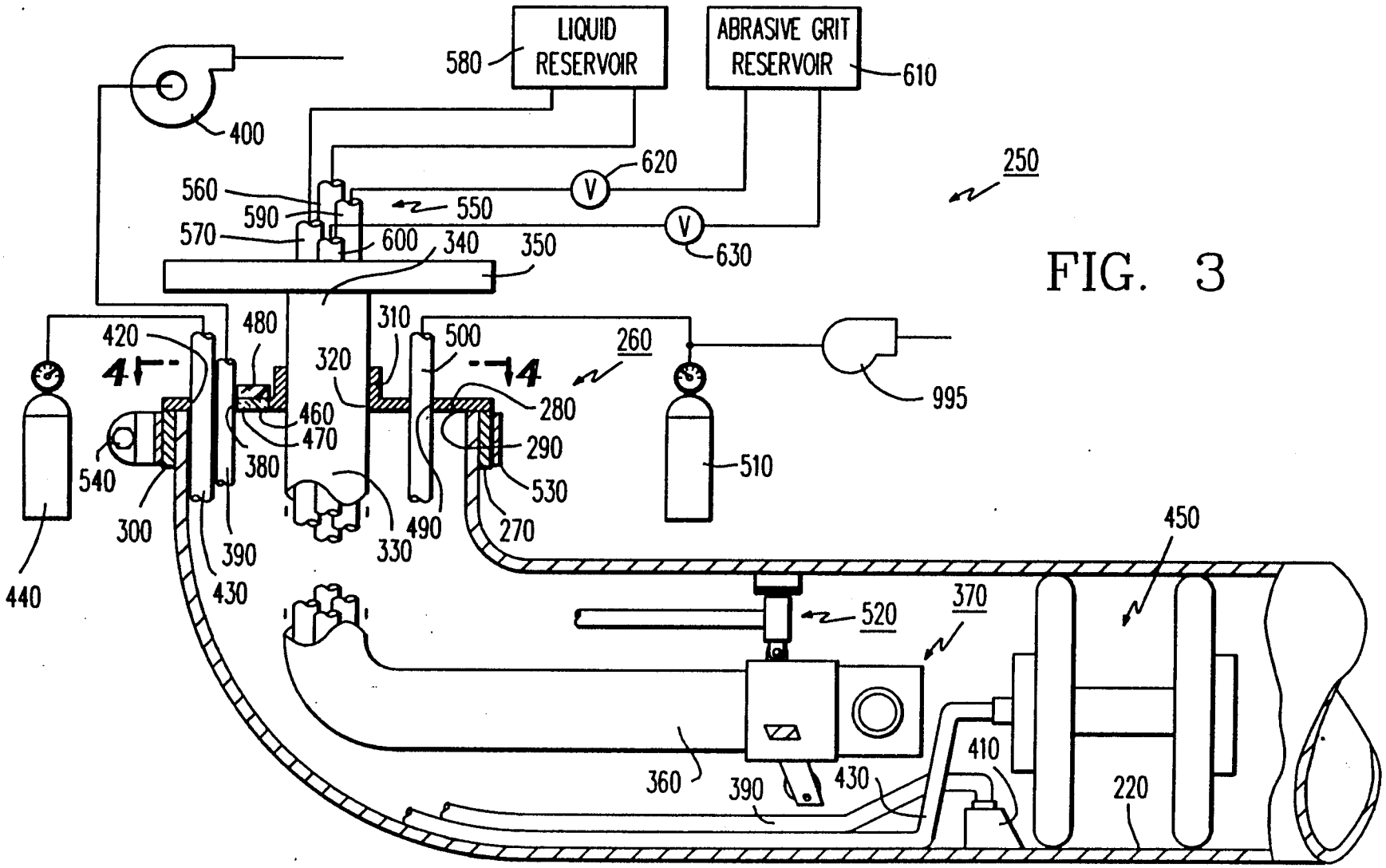
FIG. 3 is a view in partial vertical section of a steam generator pipe and of the system of the invention in operative condition to clean the pipe.

Turning now to FIGS. 2 and 3, steam generator 10 will have been removed by severing the piping connected thereto. In this regard, inlet pipe 150 and outlet pipe 180 have been severed or cut-through near first ends 170 and 190 where pipes 150 and 180 are connected to steam generator 10. Severing of inlet pipe 150 and outlet pipe 180 will create inlet pipe stub 200 and outlet pipe stub 210, which pipe stubs 200 and 210 will allow an inside surface 220 of inlet pipe 150 or outlet pipe 180 to be accessible for decontamination. As stated hereinabove, suitably decontaminating inlet pipe 150 or outlet pipe 180 will reduce the radiation dosage to maintenance personnel to a level as low as reasonably achievable. As shown in FIG. 2, a workman's platform 230 may be positioned near the pipe (e.g., inlet pipe 150 or outlet pipe 180) to be decontaminated for supporting an operator 240 who will operate a decontamination system for decontaminating inside surface 220 of inlet pipe 150 or outlet pipe 180.

Figure 4:
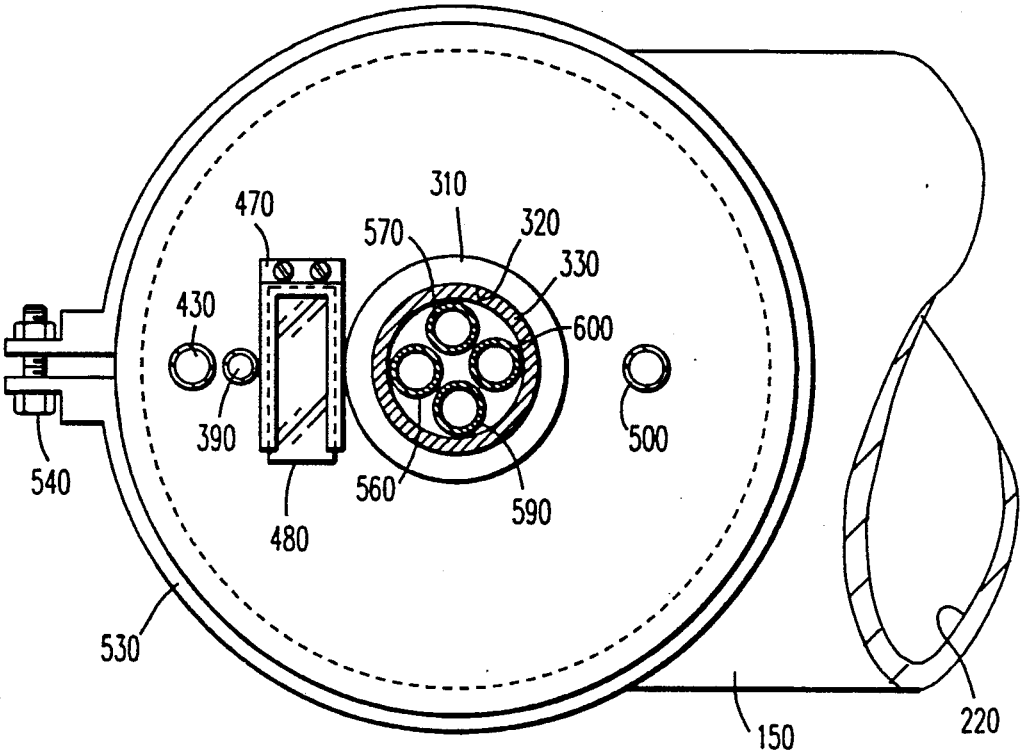
FIG. 4 is a view of a plurality of conduits in horizontal section taken along section IV—IV of FIG. 3.

Referring to FIGS. 3 and 4, there is illustrated a system, generally referred to as 250, for decontaminating inside surface 220 of a tubular member or pipe (e.g., inlet pipe 150 or outlet pipe 180). System 250 comprises covering means, generally referred to as 260, connected to inlet pipe stub 200 or outlet pipe stub 210 for substantially covering inlet pipe stub 200 or outlet pipe stub 210 to reduce radiation dosage to operator 240 and to reduce the risk that the contaminants removed from surface 220 will become airborne in the atmosphere external to pipe 150 and 180. Covering means 260, which may be rubber or the like, comprises an expandable and flexible boot or cover plate 270 having a generally disk-shaped portion 280 for covering an open end 290 defined by inlet pipe stub 200 or outlet pipe stub 210. Cover plate 270 is expandable and flexible so that it can be adjusted to pipe stubs having different outside diameters. Disk-shaped portion 280 includes an annular first flange 300 depending therefrom for surrounding inlet pipe stub 200 or outlet pipe stub 210 so that cover plate 270 can be temporarily affixed to inlet pipe stub 200 or outlet pipe stub 210 as described more fully hereinbelow. Disk-shaped portion 280 may also include an annular second flange 310 extending outwardly therefrom, which second flange 310 defines a first aperture 320 for receiving a generally tubular flexible housing 330 therethrough. Housing 330, which may be a suitable plastic or the like, is flexible so that it is capable of bending to the contour of inlet pipe 150 or outlet pipe 180. Housing 330 has a housing first end portion 340 connected to rotation means, such as a wheel 350, for rotating tubular housing 330 about its longitudinal axis, as described more fully hereinbelow. As described in more detail hereinbelow, housing 330 also has a housing second end portion 360 connected to cleaning means, such as a decontamination fixture assembly, generally referred to as 370, for cleaning inside surface 220, which fixture assembly 370 is capable of being disposed in inlet pipe 150 or outlet pipe 180. Disk-shaped portion 280 further defines a second aperture 380 for receiving a flexible, generally tubular suction line 390 therethrough. Suction line 390, which may be high strength rubber or the like, has one end connected to suction means, such as vacuum pump 400, for applying a vacuum or suction to suction line 390. Moreover, suction line 390 has another end connected to a suction head 410 for vacuuming or suctioning contaminants (not shown) abraded from inside surface 200 and for vacuuming or suctioning liquid (not shown), and/or abrasive grit (not shown) from inside surface 220. Disk-shaped portion 280 also defines a third aperture 420 for receiving a flexible, generally tubular first gas line 430 therethrough. First gas line 430, which may be high strength rubber or the like, has one end connected to a first gas reservoir 440 for supplying a first gas (not shown), such as air or nitrogen or the like, to first gas line 430. First gas line 430 has another end thereof connected to seal means, such as an inflatable dam assembly generally referred to as 450, for confining a cleaning composition (e.g., liquid and/or abrasive grit) and abraded contaminates to a predetermined portion of inside surface 220. It is important that the cleaning composition and abraded contaminants are confined and do not migrate through pipe 150 or pipe 180 to other plant equipment because the cleaning composition and abraded contaminants may cause damage to that other equipment. As described more fully hereinbelow, dam assembly 450 is inflatable for sealingly matingly contacting or engaging substantially the periphery of inside surface 220. In this regard, it is important that dam assembly 450 be inflatable for sealingly engaging substantially the entire periphery of inside surface 220 so that abraded contaminates and cleaning composition do not migrate through inlet pipe 150 or outlet pipe 180 to other plant equipment where such abraded contaminates and cleaning composition may contaminate and damage the other plant equipment. It is also important that dam assembly 450 be inflatable for expandably sealingly engaging pipes of different inside diameters.

Again referring to FIGS. 3 and 4, disk-shaped portion 280 may also include a fourth aperture 460, which may be generally rectangular, for receiving viewing means, such as window assembly 470, to view the progress of the decontamination process. Window assembly 470 includes a removable transparent pane 480, which may be high-impact glass resistant to inadvertent breakage, for viewing the progress of the decontamination process. Moreover, it is important that pane 480 be removable because removing pane 480 allows operator 240 access to the inside of inlet pipe 150 or outlet pipe 180 for suitable adjustment and maintenance of fixture assembly 370 in inlet pipe 150 or outlet pipe 180. Disk-shaped portion 280 may further include a fifth aperture 490 for receiving a second gas line 500 therethrough, which second gas line 500 is connected at one end thereof to a second gas reservoir 510 for supplying a second gas (not shown), which may be air or nitrogen or the like, to second gas line 500. Second gas line 500 is connected at another end thereof to alignment means, which may be an adjustable brace assembly generally referred to as 520 connected to fixture assembly 370, for aligning fixture assembly 370 along the longitudinal axis of inlet pipe 150 or outlet pipe 180, as described more fully hereinbelow. It is important that brace assembly 520 be adjustable so that brace assembly 520 can adjust fixture assembly 370 to pipes having different inside diameters. Moreover, extending around first flange 300 is an adjustable bendable band or clamp 530 having an adjustable fastener 540 connected thereto for temporarily affixing cover plate 270 to inlet pipe stub 200 or to outlet pipe stub 210.

Still referring to FIGS. 3 and 4, a plurality of tubes collectively referred to as 550 extend through tubular housing 330 for conducting liquid and/or abrasive grit therethrough to fixture assembly 370. Preselected tubes, such as first tube 560 and second tube 570, have one end thereof in fluid communication with a liquid reservoir 580 containing a suitable liquid such as water, for supplying liquid under pressure to first tube 560 and second tube 570. First tube 560 and second tube 570 each has another end thereof connected to fixture assembly 370 for supplying the liquid to fixture assembly 370. Other preselected tubes, such as third tube 590 and a fourth tube 600, have one end thereof connected to an abrasive grit reservoir containing a suitable dry abrasive grit, such as magnetite, aluminum oxide or boron trioxide, for supplying abrasive grit under pressure to third tube 590 and fourth tube 600. Third tube 590 and fourth tube 600 each has another end thereof connected to fixture assembly 370 for supplying the abrasive grit to fixture assembly 370. Connected to third tube 590 and to fourth tube 600 may be first valve 620 and second valve 630, respectively. First valve 620 and second valve 630 are capable of opening and closing for opening tubes 590 and 600 so that abrasive grit can be supplied to fixture assembly 370 and for closing tubes 590 and 600 so that abrasive grit will not be supplied to fixture assembly 370. As described more fully hereinbelow, closing valves 620 and 630 will allow only liquid to be supplied to fixture assembly 370 for rinsing inside surface 220 after inside surface 220 has been abraded with the liquid-abrasive cleaning composition.

Figure 5:
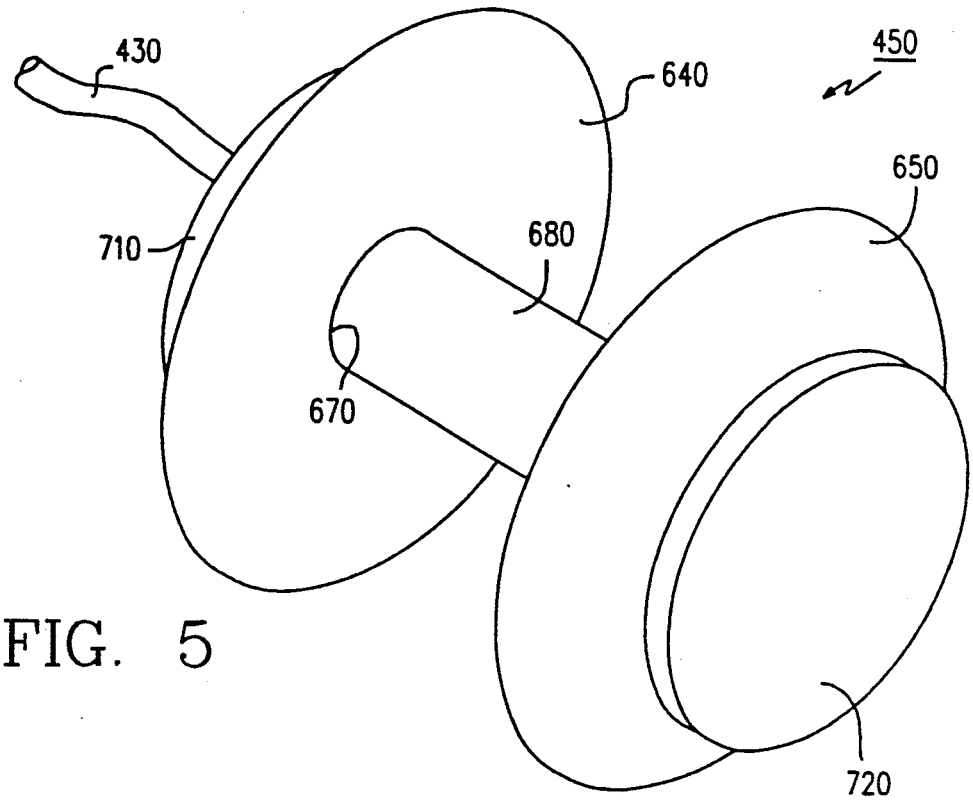
FIG. 5 is a perspective view of an inflatable torus-shaped seal.
Figure 8:
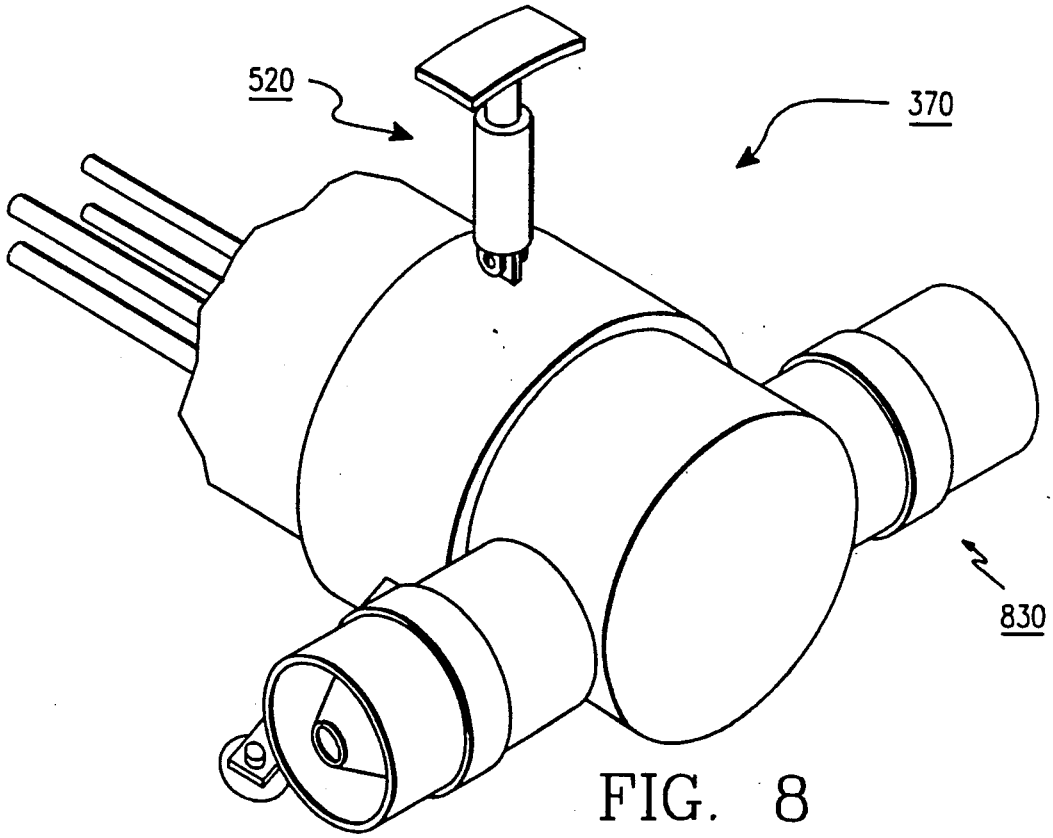
FIG. 8 is a perspective view of the fixture.

Referring now to FIGS. 5 and 6, dam assembly 450 comprises at least a first inflatable bladder 640, which may be rubber or the like, capable of expanding into sealing engagement with inside surface 220. In the preferred embodiment of the invention, dam assembly 450 may further comprise a second inflatable bladder 650. As illustrated in FIGS. 5 and 6, bladders 640 and 650 are torus-shaped for matingly sealingly engaging inside surface 220 of pipe 150 or pipe 180. Each bladder 640 and 650 defines a cavity 660 therein for inflating bladders 640 and 650. Moreover, each bladder 640 and 650 further defines a central hole 670 for receiving a generally cylindrical gas manifold 680 therethrough. Gas manifold 680 defines a compartment 690 for receiving gas therein. Gas manifold 680 also defines a gas passage 700 in communication with compartment 690 and with cavity 660. First bladder 640 and second bladder 650 are each attached, on the outboard side thereof, to a first end plate 710 and to a second end plate 720, respectively. Bladders 640 and 650 may be attached to end plates 710 and 720 and to gas manifold 680 by a suitable adhesive. First end plate 710 defines a bore 730 therethrough in communication with compartment 690 for supplying gas to compartment 690. Suitably connected to bore 730 is first gas line 430 for supplying gas to bore 730 so that bladders 640 and 650 may be inflated. First end plate 710 and second end plate 720 are attached, such as by welding, to opposite ends of gas manifold 680.

Figure 9:
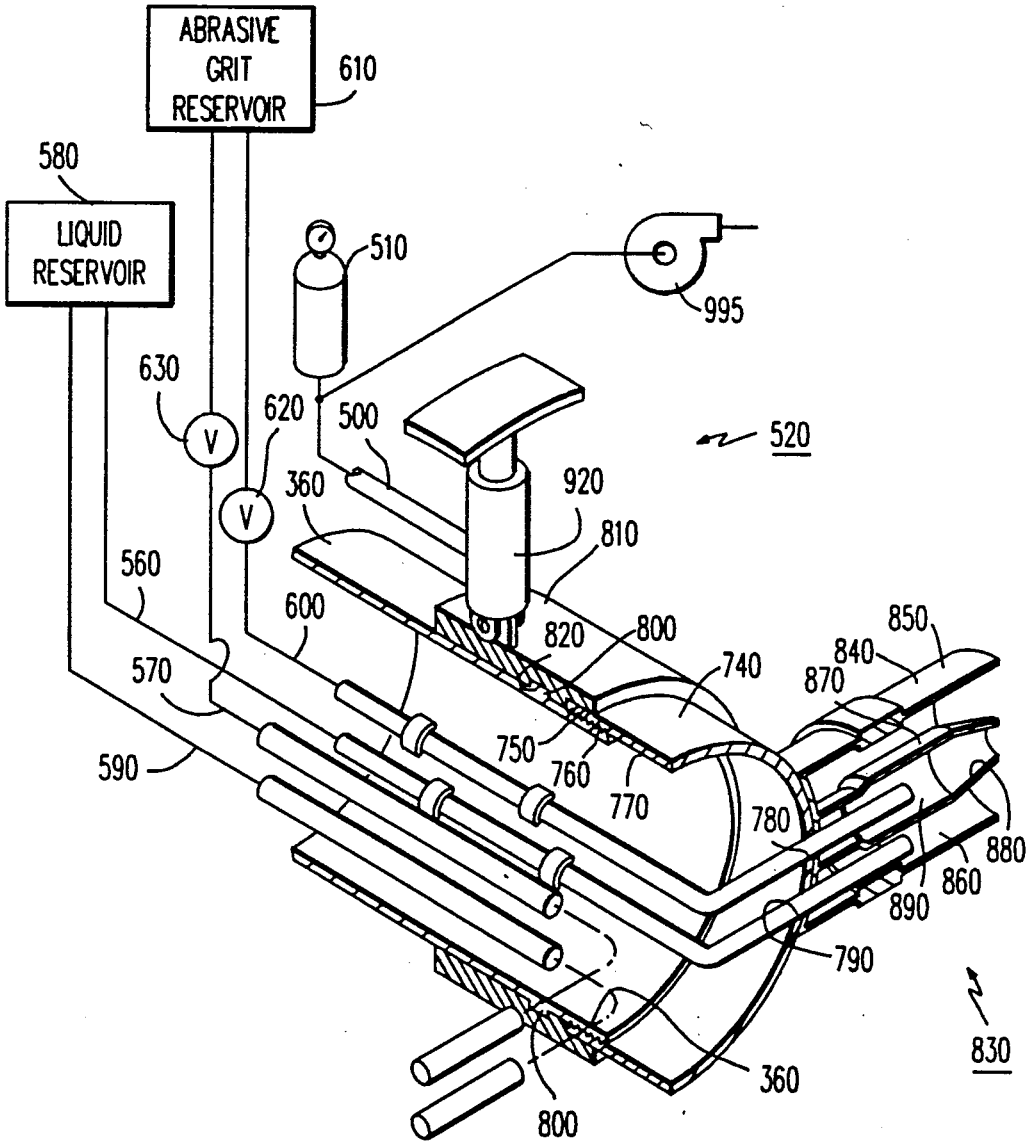
FIG. 9 is a perspective view in vertical section of the fixture.

As best seen in FIGS. 3, 6, 7, 8, and 9, fixture assembly 370 is capable of being disposed in pipe 150 or pipe 180 by inserting it through open end 290. Fixture assembly 370 comprises a hollow first cylinder 740 having an open first end portion 750 which may in turn have internal threads 760. First cylinder 740 also has a second end portion 770 defining a first hole 780 and a second hole 790 therethrough. As shown in FIG. 9, first hole 780 receives the end of fourth tube 600 therethrough and second hole 790 receives the end of first tube 560. The ends of fourth tube 600 and first tube 560 may be affixed in first hole 780 and second hole 790 by a suitable adhesive. Similarly, second tube 570 and third tube 590 are attached to other holes (not shown) corresponding to holes 780 and 790 formed through first cylinder 740. Threadably connected to first cylinder 740 is the housing second end portion 360 which is externally threaded for threadably engaging the threads 760. Housing 330 is thus connected to first cylinder 740 so that as housing 330 is rotated about its longitudinal axis, first cylinder 740 will also simultaneously rotate about its longitudinal axis. Second end portion 360 also includes a pin 800 integrally attached thereto and extending therefrom for reasons to be described presently. Surrounding first cylinder 740 is a second cylinder 810 having a circumferential groove 820 circumscribing the inner surface of second cylinder 810. Pin 800 which extends from second end portion 360 of housing 330 slidably matingly engages groove 820 so that housing 330 and first cylinder 740 are capable of rotating as rotational movement of second cylinder 810 is restricted. Alternatively, pin 800 may be a raised rail-shaped member integrally formed with housing 330 and extending around the circumference of second end portion 360 for slidably matingly engaging groove 820.

Still referring to FIGS. 3, 6, 7, 8, and 9, attached to first cylinder 740 is a nozzle block assembly, generally referred to as 830, for spraying the liquid-abrasive grit composition under pressure against inside surface 220 so that inside surface 220 can be decontaminated. Nozzle block assembly 830 comprises a generally cylindrical outer nozzle 840 having a first end integrally attached to first cylinder 740 and having an open second end 850 for exit of liquid under pressure. Outer nozzle 840 defines a longitudinal first channel 860 therethrough, which first channel 860 is in communication with second hole 790 for conducting liquid from first tube 560, into first channel 860, and out second end 850. Disposed in first channel 860 is a generally cylindrical inner nozzle 870 having a first end integrally attached to first cylinder 740 and having an open second end 880 for exit of abrasive grit under pressure. Second end 880 may be frusto-conical for reasons described thereinbelow. Inner nozzle 870 defines a longitudinal second channel 890 therethrough, which second channel 890 is in communication with first hole 780 for conducting abrasive grit from fourth tube 600, into second channel 890, and out second end 880. It will be understood that as the liquid exits outer nozzle 840 under pressure and as the abrasive grit exits inner nozzle 870 under pressure, the liquid and the abrasive grit will mix or combine to form a liquid-abrasive grit composition which will then impinge inside surface 220 for decontaminating inside surface 220. In this regard, the frusto-conical shape of end 880 will distribute the exit flow of the abrasive grit such that it will sufficiently mix with the liquid at a predetermined distance beyond the end of the nozzle block 830. Moreover, integrally attached to second cylinder 810 and extending outwardly therefrom is at least one leg 900 having a roller member 910 connected to the end thereof. Leg 900 assists in supporting fixture 370 in pipe 150 or 180. Roller member 910 also enables fixture 370 to be rolled along inside surface 220.

Figure 10:
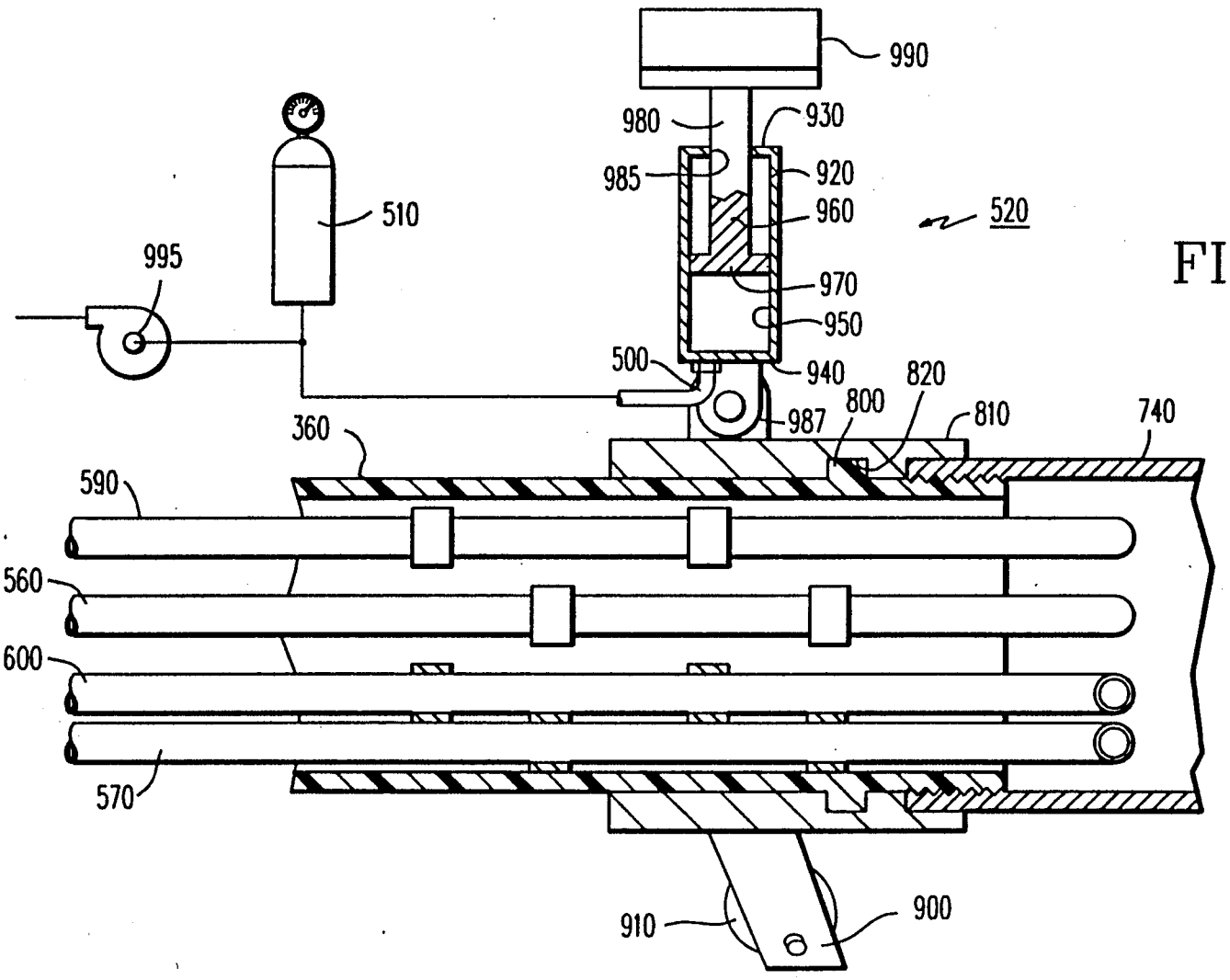
FIG. 10 is a view in vertical section of a pneumatic brace assembly connected to the fixture.
Figure 11:
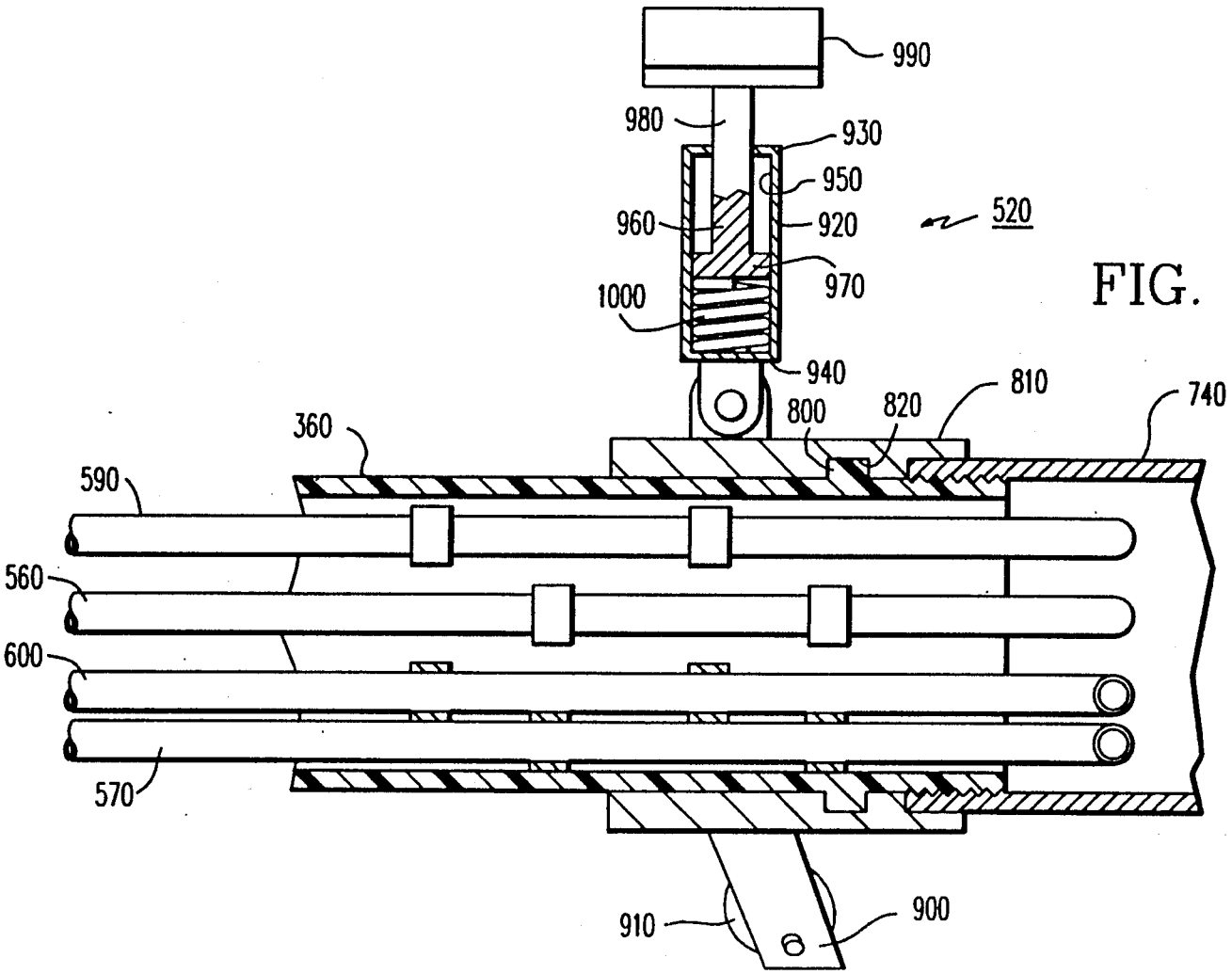
FIG. 11 is a view in vertical section of a spring-biased brace assembly connected to the fixture.
Figure 12:
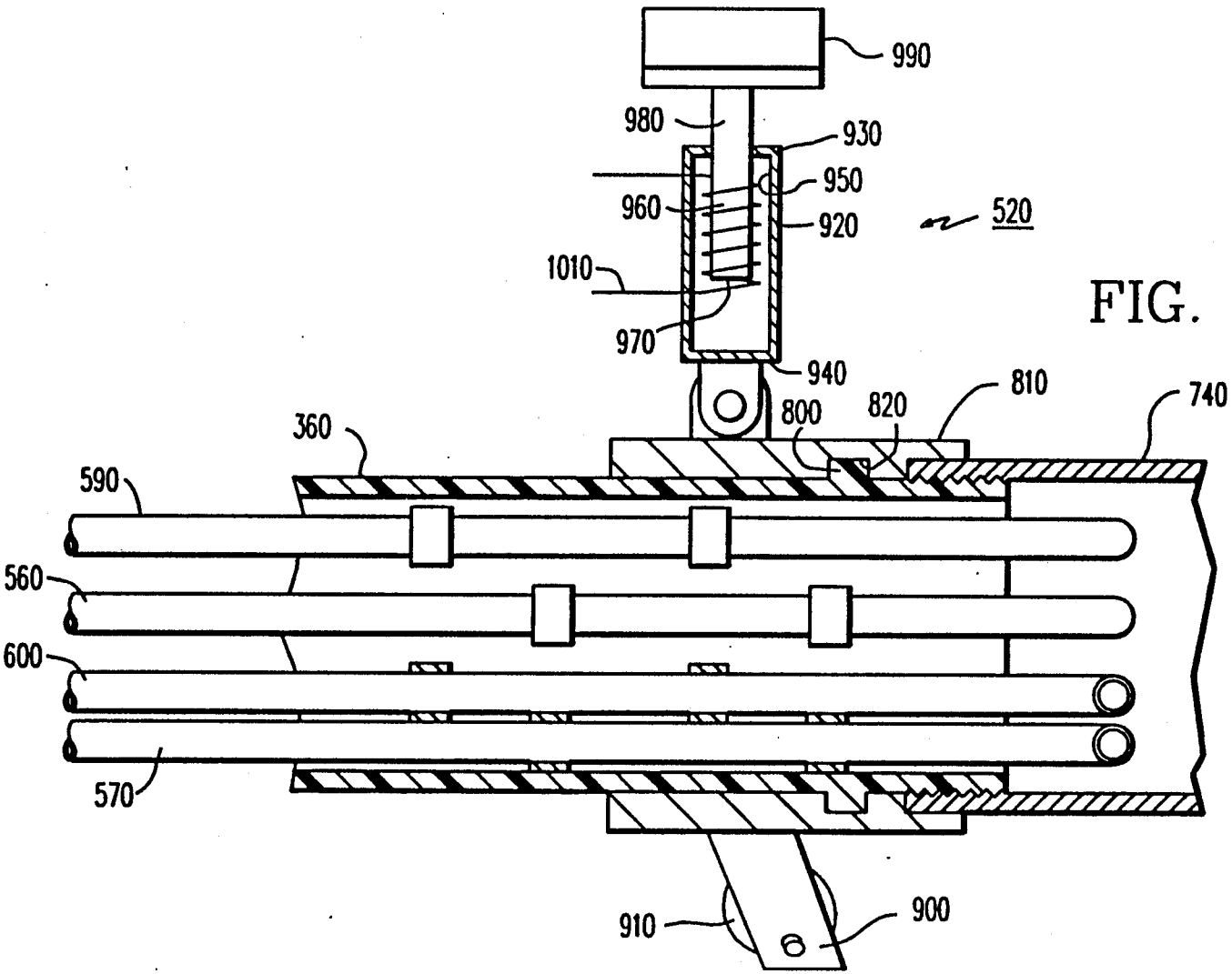
FIG. 12 is a view in vertical section of a motor-operated brace assembly connected to the fixture.

With particular reference to FIGS. 10, 11, and 12, brace assembly 520 comprises a generally cylindrical body portion 920 having a first end 930 and a second end 940. Body portion 920 defines a chamber 950 for slidably receiving a piston 960 having a first end portion 970 and a second end portion 980. Body portion 290 also defines a bore 985 of diameter smaller than the diameter of chamber 950 for receiving second end portion 980 therethrough. First end portion 970 is disposed in chamber 950 and second end portion 980 extends through bore 985 and beyond first end 930 of body portion 920. Second end 940 of body portion 920 is connected to second cylinder 810 via connector 987. Integrally attached to the end of second end portion 980 is a generally hemispherical-shaped brace pad 990 for engaging inside surface 220 to stabilize fixture assembly 370 in pipe 150 or pipe 180. In the preferred embodiment, an end of second gas line 500 is in communication with chamber 950 for supplying the second gas to chamber 950. It will be understood that when the second gas is supplied to chamber 950 the gas will exert a force against first end portion 970 for biasing or translating piston 960, and the brace pad 990 attached thereto, outwardly to engage inside surface 220. A vacuum pump 995 may be connected to second gas line 500 for producing a vacuum in chamber 950 so that piston 960 will disengage from surface 220. Thus, brace assembly 520 may be a pneumatic (e.g., gas-activated) brace for engaging brace pad 990 into and disengaging brace pad 990 from inside surface 220. Alternatively, brace assembly 520 may be mechanical (see FIG. 11) as described immediately hereinbelow. As shown in FIG. 11, interposed between second end 940 and first end portion 970 may be a spring 1000 for biasing or translating piston 960, and the brace pad 990 attached thereto, outwardly to engage inside surface 220. On the other hand, brace assembly 520 may be electrically operated by a suitable motor (see FIG. 12). As shown in FIG. 12, disposed in chamber 950 may be an electric motor 1010 in electromagnetic communication with first end portion 970 for biasing or translating piston 960, and the brace pad 990 attached thereto, into engagement with and disengagement from inside surface 220. Biasing brace pad 990 into engagement with inside surface 220 stabilizes fixture 370 in pipe 150 or 180. It will be understood that brace assembly 520 allows fixture 370 to be stabilized in pipes having different inside diameters.

METHOD OF OPERATION

To clean the inside surface of a pipe, such as inlet pipe 150 or outlet pipe 180, inflatable dam assembly 450 is inserted, preferably in a deflated condition, through open end 290 of inlet pipe 150 or outlet pipe 180. Dam assembly 450 may be positioned in pipe 150 or pipe 180 by any suitable means, such as by a flexible elongated pole (not shown) capable of pushing cam assembly 450 along inside surface 220. When dam assembly 450 is suitably positioned a predetermined distance beyond the location where decontamination of inside surface 220 is desired, the first gas is supplied to first gas line 430. The first gas flows through first gas line 430, through bore 730 and into compartment 690 which is formed in dam assembly 450. The first gas then flows from compartment 690, through gas passage 700 and into cavity 660 for inflating first bladder 640 and second bladder 650 into sealing engagement with inside surface 220. First bladder 640 and second bladder 650 may be inflated to a pressure of approximately 75 pounds per square inch (psi) to suitably engage the inner diameter of pipe 150 or 180, which inner diameter may be between approximately 29 inches and 31 inches in the case of the typical pressurized water reactor nuclear steam generator. First bladder 640 should confine the abraded contaminants and cleaning composition to the area of inside surface 220 that is between first bladder 640 and open end 290. However, should first bladder 640 not contain the abraded contaminants and cleaning composition to the predetermined area, then second bladder 650 will function as a redundant second barrier for containing the abraded contaminants and cleaning composition to the area of inside surface 220 designated for decontamination. In this manner, abraded contaminants and cleaning composition will not migrate beyond second bladder 650 to contaminate and damage plant equipment that may be connected to inlet pipe 150 or outlet pipe 180. Each bladder 640 or 650 is circular and torus-shaped for matingly sealingly engaging the circular periphery of inside surface 220. It will be appreciated that the unitary structure of dam assembly 450 allows it to be rapidly installed and removed.

Fixture assembly 370, with housing 330 connected thereto, is positioned near the area of inside surface 220 where decontamination is to begin. Fixture assembly 370 may be positioned in pipe 150 or pipe 180 by moving housing 330 into pipe 150 or pipe 186. Moving housing 330 will allow fixture assembly 370 to roll along inside surface 220 on roller member 910. When fixture assembly 370 reaches the area of inside surface 220 to be decontaminated, the second gas is caused to flow into second gas line 500 for pressurizing chamber 950 formed in brace assembly 520. Pressurizing chamber 950 will cause piston 960 to move outwardly toward inside surface 220 to engage brace pad 990 with inside surface 220. When brace pad 990 engages inside surface 220, fixture assembly 370 will be stabilized in pipe 150 or pipe 180 so that fixture assembly 370 will not substantially move when operated. Moreover, when brace pad 990 engages inside surface 220, fixture assembly 370 will also be substantially aligned with the longitudinal axis of pipe 150 or pipe 180. As described hereinabove, brace assembly 520 may be gas-activated, motor-activated or spring-activated for biasing brace pad 990 into engagement with inside surface. It is important that fixture assembly 370 be stabilized and substantially aligned with respect to the longitudinal axis of the pipe so that second end 850 of outer nozzle 840 and second end 880 of inner nozzle 870 will always be spaced a predetermined distance from inside surface 220 to provide sufficient space for the suitable mixing of the abrasive grit and liquid after the abrasive grit and liquid exit nozzle block 830.

It is important that the contaminants abraded from inside surface 220 not escape through open end 290 of pipe 150 or 180 and become airborne in the atmosphere external to pipe 150 and 180. If the abraded contaminants were to travel out open end 290 and become airborne, then the atmosphere external to pipe 150 and 180 would become radioactively contaminated. To reduce the risk of such contamination, boot 260 is placed on outlet pipe stub 200 or inlet pipe stub 210 such that cover plate 70 covers open end 290 for reducing radiation dosage to operator 240 and for reducing the risk that abraded contaminants and cleaning composition will inadvertently migrate through open end 290 and become air-borne. Boot 260 is preferably expandable for fitting pipe stubs of different diameters. When boot 260 is properly fitted on pipe stub 200 or 210, depending first flange 300 will surround pipe stub 200 or 210. Clamp 530 is placed around first flange 300 and pipe stub 200 or 210 and tightened thereagainst by tightening fastener 540. In this manner boot 260 is removably affixed to outlet pipe stub 200 or inlet pipe stub 210. Moreover, removable window 390 can be temporarily removed to finally adjust the positions of fixture assembly 370 and/or dam assembly 450 in pipe 150 or 180. Window 390 is replaced prior to commencing the decontamination operation.

To begin the decontamination operation, liquid under pressure is caused to flow from liquid reservoir 580 into first tube 560 and second tube 570, which liquid then flows through first tube 560 and second tube 570 to first channel 860. Abrasive grit, such as boron trioxide, is caused to flow under pressure from abrasive grit reservoir 610 into third tube 590 and fourth tube 600, which abrasive grit then flows through third tube 590 and fourth tube 600 to second channel 890. As the liquid exits first channel 860, the liquid will intermix and combine with the abrasive grit exiting second channel 890. This combination of liquid and abrasive grit forms the cleaning composition that will abrade the contaminants from inside surface 220. It is contemplated that one decontamination pass along surface 220 will use the cleaning composition to decontaminate inside surface 220 and a second pass will use only water to rinse or wash residual cleaning composition and contaminates from inside surface 220. During the second pass, valves 620 and 630 are closed thereby stopping the flow of abrasive grit to fixture assembly 370 as the flow of liquid (e.g., water) continues to flow from liquid reservoir 580 to fixture assembly 370. Of course, the cleaning process may be repeated by performing additional cleaning passes to remove contamination when the contamination is strongly bonded to inside surface 220.

As the cleaning composition impinges inside surface 220, wheel 350 is rotated. Wheel 350 may be rotated manually by operator 240. Alternatively, wheel 240 may be rotated by suitable motor means such as a reversible motor (not shown). Because wheel 350 is attached to housing first end portion 340, housing 330 will rotate as wheel 350 rotates. Moreover, because housing second end portion 360 threadably engages first end portion 750 of first cylinder 740, first cylinder 740 will rotate as housing 330 rotates. It will be understood that second cylinder 810 will not rotate when housing 330 rotates because pin 800 will slide in groove 820 formed in second cylinder 810. At least one nozzle block 830 is attached to first cylinder 740; therefore, as first cylinder 740 rotates, nozzle block 830 will rotate in a 360 degree circle about the axis of rotation coinciding with the longitudinal axis of first cylinder 740. Rotation of nozzle block 830 in the manner described hereinabove, will allow the cleaning composition to impinge the entire periphery of inside surface 220.

A reactive force will be experienced by fixture assembly 370 as the cleaning composition, which is under pressure, exits nozzle block 830. This reactive force will be opposite and substantially equal to the force with which the cleaning composition impinges inside surface 220. The reactive force will tend to destabilize and vibrate fixture assembly 370 to such an extent that the predetermined distance between the ends 840/880 of nozzle block 830 and inside surface 220 might not be maintained. Maintaining the predetermined distance between the ends 840/880 of nozzle block 830 and inside surface 220 assists in ensuring that sufficient space will exist for suitable mixing of the abrasive grit and liquid when the abrasive grit and liquid exit nozzle block 830. In this regard, when fixture assembly 370 is positioned at the location where decontamination is to occur a second gas is caused to flow from second gas reservoir to second gas line 500. The second gas then enters chamber 950 for moving piston 960 toward inside surface 220 until brace pad 990 intimately engages inside surface 220 for stabilizing fixture assembly 370. In the preferred embodiment, engaging brace pad 990 with inside surface 220 creates three points of contact between fixture assembly 370 and inside surface 220. That is, fixture assembly 370 will contact inside 220 at each of the two roller members 910 and at brace pad 990 for stabilizing fixture assembly 370 It will be understood that brace pad 990 may be disengaged from inside surface 220 by stopping the flow of the second gas into chamber 950 and then operating vacuum pump 995 to create a vacuum in chamber 950. Of course, brace pad 990 need not be pneumatically operated. Brace pad 990 may be spring-biased or may be operated by an electric motor.

During operation of steam generator 10, which operation is described hereinabove, the radioactive water moderator and the metallic surface of pipes 150 and 180 chemically react over time to form a radioactive oxide film corrosion product or contaminant on inside surface 220. According to this invention, suitable liquid-abrasive grit can be used to abrade away the radioactive oxide film or contaminants from inside surface 220. It should be understood that a choice of abrasive grit is made on the basis of surface decontamination factor requirements, waste processing capabilities and limitations, and chemistry compatibility considerations. Typical abrasive grits are boron trioxide, magnetite, and alumina. In the case of water soluble boron trioxide, an achievable surface decontamination factor is between three and six, where the decontamination factor is defined as:

$$\text{Decontamination Factor} = \frac{\text{Surface initial radioactivity value}}{\text{Surface final radioactivity value}}$$

A decontamination factor between three and six is sufficient to reduce the radioactivity exposure of operator 240 to a level that is as low as reasonably achievable in this particular application.

The combination of abrasive grit and liquid (e.g., boron trioxide and water) may be selected such that a slurry cleaning composition is formed having approximately three to five percent solids by weight. For decontaminating the typical pressurized water reactor nuclear steam generator inlet or outlet pipe, the water may have a flow rate through each of the two nozzle blocks 830 of approximately 11 gallons per minute with a water pressure of approximately 4,000 pounds per square inch (psi). When boron trioxide is selected as the abrasive grit, the amount of waste water generated to decontaminate one foot length of inside surface 220 may be approximately 500 to 550 gallons if two passes are made across the area undergoing decontamination. The first pass will be for the abrasion phase of the decontamination and the second pass will be for rinsing the abraded area. Housing 330 may be operated to push fixture assembly 370 along inside surface 220 such that nozzle block 830 will travel along inside surface 220 at a speed of approximately three feet per minute during decontamination and at a speed of approximately 12 feet per minute during rinsing of inside surface 220. Nozzle blocks 830 should be rotated at a speed sufficient to cover the desired area of inside surface 220. The abrasive grit reservoir 610 will supply the abrasive grit such that the combined flow rate of the abrasive grit to both nozzle blocks 830 will total about three to four pounds mass per minute. Thus, in the preferred embodiment, each of the two nozzle blocks 830 will cause about one and one-half pounds mass per minute to two pounds mass per minute of abrasive grit to exit each nozzle block 830.

As stated hereinabove, following decontamination with the liquid-abrasive grit spray during the first pass, inside surface 220 is sprayed with high pressure water to flush residual grit from inside surface 220. This rinse cycle is performed during the second pass by repeating the sweep pattern without the addition of abrasive grit (e.g., closing first and second valves 620 and 630) and by operating fixture assembly 370 at a higher speed (e.g., approximately 12 feet per minute).

Next, suction head 410 is positioned on inside surface 220 for vacuuming or suctioning abraded contaminants and cleaning composition from the abraded area. When vacuum pump 400 is operated, a partial vacuum is created in suction line 390, which partial vacuum is also created in suction head 410. Vacuum pump 400 may a diaphragm pump capable of attaining approximately 150 feet of head. The vacuum existing in suction head 410 will cause abraded contaminants and cleaning composition dispersed near suction head 410 to migrate into suction head 410 for removal from pipe 150 or pipe 180. If desired, suction head 410, which may be a commercially available suction head, may be positioned in pipe 150 or pipe 180 by the pole (not shown) referred to hereinabove. Suctioning of the abraded contaminants and cleaning composition from inside surface 220 may be performed after fixture assembly 370 has been retrieved from within pipe 150 or pipe 180.

In the case of the typical pressurized water nuclear reactor steam generator inlet or outlet pipe, the decontamination will be performed on inside surface 220 for a length of approximately six feet beyond open end 290 of inlet pipe 150 or outlet pipe 180 or approximately three feet beyond the elbow portion of pipe 150 or pipe 180, the pipe having an inside diameter between approximately 29 inches and 31 inches for the typical pressurized water reactor nuclear steam generator. Dam assembly 450 therefore may be installed at approximately six feet from open end 290.

Of course, it will be understood that modifications and variations may be effected without departing from the spirit and scope of the novel concepts of the present invention. Moreover, it should be further understood that the system and method described herein may be used to clean any tubular member and need not be limited to the decontamination of steam generator inlet and outlet piping. In addition, the system and method described herein need not be limited to cleaning radioactively contaminated surfaces; rather, the invention described herein may be used to clean non-radioactive surfaces of virtually any scale, film, incrustation or the like.

Therefore, what is provided is a system and method for abrading radioactive contaminants from the inside surface of a pipe, wherein the system includes suitable seal means for confining a liquid-abrasive grit cleaning composition to a predetermined portion of the inside surface of the pipe so that substantially all of the contaminants and cleaning composition can be removed from the surface.

What is claimed is:

1. A system for cleaning the inside surface of a tubular member, the tubular member defining a longitudinal axis therethrough, comprising:

(a) cleaning means capable of being positioned in the tubular member for displacing a cleaning composition onto the inside surface of the tubular member to clean the inside surface of the tubular member;

(c) inflatable seal means disposed to one side of said cleaning means, said inflatable seal means capable of contacting the inside surface of the tubular member for confining the cleaning composition to a predetermined portion of the inside surface of the tubular member, said seal means being positionable along the inside surface of the tubular member independently of said cleaning means; and (c) an adjustable brace assembly connected to said cleaning means for stabilizing said cleaning means in the tubular member, for aligning said cleaning means along the longitudinal axis of the tubular member and for adjusting said cleaning means to tubular members having different inside diameters.

2. The system according to claim 1, wherein said seal means is an inflatable dam assembly for expansibly sealably engaging the inside surface of the tubular member.

3. A system for the cleaning the inside surface of a pipe, the pipe defining a longitudinal axis therethrough, comprising:

(a) cleaning means capable of being positioned in the pipe for spraying a pressurized slurry against the inside surface of the pipe to clean contaminants from the inside surface of the pipe;

(b) inflatable seal means disposed to one side of said cleaning means for sealably contacting the inside surface of the pipe to confine the slurry to a predetermined portion of the inside surface of the pipe, said seal means being positionable along the inside surface of the pipe independently of said cleaning means; and (c) an adjustable brace assembly connected to said cleaning means for stabilizing said cleaning means in the pipe and for aligning said cleaning means along the longitudinal axis of the pipe, said brace assembly defining a chamber therein.

4. The system according to claim 3, wherein said seal means is an inflatable dam assembly for expansibly sealably engaging the inside surface of the pipe to confine the slurry and contaminants to the predetermined portion of the inside surface of the pipe.

5. The system according to claim 4, wherein said brace assembly further comprises a piston having a first piston end portion disposed in the chamber defined by said brace assembly and having a second piston end portion capable of abutting the inside surface of the pipe for stabilizing said cleaning means in the pipe and for aligning said cleaning means along the longitudinal axis of the pipe.

6. The system according to claim 5, further comprising means connected to said cleaning means for supplying the pressurized slurry to said cleaning means.

7. The system according to claim 6, further comprising:

(a) suction means capable of being disposed on the inside surface of the pipe and near said cleaning means for suctioning the slurry from the inside surface of the pipe;

(b) a second gas line having one end in communication with a second gas reservoir and having another end in communication with the chamber for delivering the second gas to the chamber to bias said piston into intimate engagement with the inside surface of the pipe; and (c) an electric motor disposed in the chamber proximate the second piston end portion for electromagnetically biasing the second piston end portion into intimate engagement with the inside surface of the pipe.

8. The system according to claim 7, further comprising a spring disposed in the chamber and contacting the first piston end portion for biasing said piston into intimate engagement with the inside surface of the pipe.

9. A system for decontaminating the inside surface of a pipe, the pipe defining a longitudinal axis therethrough, the pipe having an open end, the inside surface having radioactive contaminants thereon, comprising:

(a) a fixture assembly capable of being inserted through the open end of the pipe and capable of being positioned in the pipe for spraying a pressurized water-grit slurry against the inside surface of the pipe to abrade the contaminants from the inside surface of the pipe;

(b) an inflatable dam assembly capable of being disposed in the pipe to one side of said fixture assembly for expansibly sealably engaging the inside surface of the pipe to confine the water-grit slurry and contaminants to a predetermined portion of the inside surface of the pipe, said dam assembly being positionable along the inside surface of the pipe independently of said fixture assembly; and (c) an adjustable brace assembly connected to said fixture assembly for contacting the inside surface of the pipe to stabilize said fixture assembly in the pipe and to align said fixture parallel to the longitudinal axis of the pipe.

10. The system according to claim 9, wherein said dam assembly is an inflatable torus for matingly engaging the inside surface of the pipe.

11. The system according to claim 10, wherein said fixture assembly further comprises (a) a rotatable hollow first cylinder defining a longitudinal axis therethrough, said first cylinder having an open first end and a second end portion having a first aperture and a second aperture formed through the second end portion (b) a hollow generally cylindrical housing defining a longitudinal axis therethrough said housing extending into the open first end of said first cylinder, said housing attached to said first cylinder so that said first cylinder rotates about the longitudinal axis defined thereby;

(c) a second cylinder surrounding a portion of said first cylinder and connected to said brace assembly for supporting said brace assembly;

(d) a nozzle block connected to said first cylinder for spraying the water-grit mixture against the inside surface of the pipe, said nozzle block including:

(i) a generally cylindrical outer nozzle having a first end and a second end, the first end of said outer nozzle attached to said first cylinder, said outer nozzle defining a longitudinal first channel therethrough for passage of the water through the first channel and out the second end of said outer nozzle, the first channel in communication with the first aperture formed through the second end portion of said first cylinder; and (ii) a generally cylindrical inner nozzle disposed in the first bore of said outer nozzle, said inner nozzle having a first end and a second end, the first end of said inner nozzle attached to said first cylinder and the second end of said inner nozzle terminating in a frusto-conical end portion for combining the grit and the water to form a water-grit slurry for abrading the contaminants from the inside surface of the pipe, said inner nozzle defining a longitudinal second channel therethrough for passage of the grit through the second channel and out the second end of said inner nozzle, the second channel in communication with the second aperture formed through the second end portion of said first cylinder.

12. The system according to claim 10, wherein said brace assembly has a body portion having a first end and a second end, said body portion defining a chamber therein, said body portion defining a bore extending from the chamber through the second end of said body portion.

13. The system according to claim 12, further comprising a piston having a first piston portion disposed through the bore and into the chamber and having a second piston end portion extending beyond the second end of said body portion.

14. The system according to claim 13, further comprising a brace assembly pad attached to the second piston end portion for engaging the inside surface of the pipe to stabilize the fixture assembly in the pipe.

15. The system according to claim 14, wherein said brace assembly pad is convex for matingly engaging the inside surface of the pipe.

* * * * *